US010842701B2

(12) United States Patent
Paul et al.

(10) Patent No.: US 10,842,701 B2
(45) Date of Patent: Nov. 24, 2020

(54) PATIENT SUPPORT APPARATUS WITH STABILIZATION

(71) Applicant: Stryker Corporation, Kalamazoo, MI (US)

(72) Inventors: Anish Paul, Portage, MI (US); Joseph Adam Upchurch, Kalamazoo, MI (US); Matthew A. Cutler, Portage, MI (US); Tyler Joseph Ethen, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 360 days.

(21) Appl. No.: 15/730,343

(22) Filed: Oct. 11, 2017

(65) Prior Publication Data

US 2018/0104126 A1 Apr. 19, 2018

Related U.S. Application Data

(60) Provisional application No. 62/408,120, filed on Oct. 14, 2016.

(51) Int. Cl.
*A61G 15/02* (2006.01)
*A61G 15/00* (2006.01)
(Continued)

(52) U.S. Cl.
CPC ..... *A61G 15/02* (2013.01); *A61G 5/1089* (2016.11); *A61G 13/04* (2013.01); *A61G 13/104* (2013.01);
(Continued)

(58) Field of Classification Search
CPC ..... A61G 15/02; A61G 5/1089; A61G 15/12; A61G 13/104; A61G 13/04; A61G 15/002;
(Continued)

(56) References Cited

U.S. PATENT DOCUMENTS 603,896 A * 5/1898 Dixon ..... A47C 1/146 297/377
668,479 A 2/1901 Beihl
(Continued)

FOREIGN PATENT DOCUMENTS

AU 2001268247 B2 12/2001
AU 2004225091 A1 10/2004
(Continued)

OTHER PUBLICATIONS

Modular Patient System (MPS) 3000 Bed Maintenance Manual.

*Primary Examiner* — Myles A Throop
(74) *Attorney, Agent, or Firm* — Warner Norcross + Judd LLP

(57) ABSTRACT

A patient support apparatus includes a base, a seat supported by the base and a backrest pivotable between an upright position and a reclined position. In one embodiment, a backrest support member is coupled to the backrest and is adapted to move between a stowed position in which the backrest support member does not support the backrest and a deployed position in which the backrest support member does support the backrest. Movement to the deployed position occurs in response to activation of an emergency control. In other embodiments, the base includes a portion that moves into an extended position underneath the backrest when the backrest is in the reclined position. Movement of the base portion to the extended position also occurs in response to activation of an emergency control.

20 Claims, 7 Drawing Sheets

(51) Int. Cl.

| | |
|---|---|
| ***A61G 13/04*** | (2006.01) |
| ***A61G 13/10*** | (2006.01) |
| ***A61G 15/12*** | (2006.01) |
| ***A61G 5/10*** | (2006.01) |
| ***A61G 13/00*** | (2006.01) |
| ***A61G 13/12*** | (2006.01) |

(52) U.S. Cl.
CPC ..... *A61G 15/002* (2013.01); *A61G 15/12* (2013.01); *A61G 13/0036* (2013.01); *A61G 13/1225* (2013.01); *A61G 13/1245* (2013.01)

(58) Field of Classification Search
CPC ..... A61G 13/1245; A61G 13/1225; A61G 13/0036
See application file for complete search history.

(56) References Cited

U.S. PATENT DOCUMENTS 815,819 A * 3/1906 Harllee ..... A47C 19/122 5/111
1,281,074 A * 10/1918 Russell ..... A47C 20/027 5/634
1,865,030 A * 6/1932 McCauley ..... A47C 1/146 297/372
2,140,310 A * 12/1938 Brown ..... A47C 16/005 297/1
2,306,031 A 12/1942 Anderson et al.
2,821,406 A 1/1958 Hoyer et al.
2,832,655 A 4/1958 Adolphson
3,211,495 A * 10/1965 Nielsen ..... A47C 20/043 297/68
3,270,574 A 9/1966 Stewart et al.
3,305,876 A 2/1967 Hutt
3,329,979 A * 7/1967 Drapin ..... A47C 20/027 5/634
3,719,391 A * 3/1973 Neri ..... A61G 15/02 297/341
3,721,232 A 3/1973 Trenchard
3,738,705 A * 6/1973 Hill ..... A47C 17/162 297/377
3,818,516 A * 6/1974 Hopper ..... A61B 6/04 5/611
3,822,424 A * 7/1974 Messer ..... A47C 1/146 5/419
4,097,939 A 7/1978 Peck et al.
4,222,131 A * 9/1980 Holdt ..... A47C 20/042 5/617
4,345,344 A 8/1982 Gadoury et al.
4,432,353 A 2/1984 Vrzalik
4,439,878 A * 4/1984 Stevens ..... A47C 17/225 297/313
4,647,130 A 3/1987 Blair et al.
4,660,237 A * 4/1987 Brodnax ..... A47C 7/383 297/377
4,664,456 A 5/1987 Blair et al.
4,682,376 A 7/1987 Feldt
4,724,555 A 2/1988 Poehner et al.
4,812,133 A 3/1989 Fleak et al.
4,985,946 A 1/1991 Foster et al.
5,022,105 A 6/1991 Catoe
5,050,899 A 9/1991 Stensby
5,077,843 A 1/1992 Foster et al.
5,148,562 A 9/1992 Borders et al.
5,179,744 A 1/1993 Foster
5,181,286 A 1/1993 McNulty
5,230,113 A * 7/1993 Foster ..... A61G 5/14 5/604
5,279,010 A 1/1994 Ferrand et al.
5,317,769 A 6/1994 Weismiller et al.
5,335,384 A 8/1994 Foster et al.
5,392,475 A 2/1995 McCall et al.
5,404,604 A 4/1995 Has et al.
5,418,987 A 5/1995 Yoshino
5,423,097 A 6/1995 Brulé et al.
5,425,567 A * 6/1995 Albecker, III ..... A47C 1/146 297/377
5,432,966 A 7/1995 Berta et al.
5,469,588 A 11/1995 DiMatteo et al.
5,594,961 A 1/1997 Yokoi
5,613,255 A 3/1997 Bish et al.
5,640,730 A 6/1997 Godette
5,713,091 A 2/1998 Houchin
5,715,548 A 2/1998 Weismiller et al.
5,733,320 A 3/1998 Augustine
5,743,594 A * 4/1998 Suskey ..... A47C 17/16 297/354.13
5,745,937 A 5/1998 Weismiller et al.
5,790,997 A 8/1998 Ruehl
6,021,533 A 2/2000 Ellis et al.
6,071,579 A 6/2000 Green et al.
6,161,236 A 12/2000 Carroll
6,163,903 A 12/2000 Weismiller et al.
6,209,157 B1 4/2001 Hensley
6,212,714 B1 4/2001 Allen et al.
6,230,344 B1 5/2001 Thompson et al.
6,250,712 B1 * 6/2001 Livington ..... A47C 1/146 297/129
6,295,675 B1 10/2001 Ellis et al.
6,320,510 B2 11/2001 Menkedick et al.
6,351,861 B1 3/2002 Shows et al.
6,357,065 B1 3/2002 Adams
6,405,393 B2 6/2002 Megown
6,427,264 B1 8/2002 Metz et al.
6,467,113 B2 10/2002 Ellis et al.
6,473,922 B1 11/2002 Sommerfeld et al.
6,496,993 B2 12/2002 Allen et al.
6,505,365 B1 * 1/2003 Hanson ..... A61G 7/005 5/510
6,526,609 B2 3/2003 Wong
6,539,566 B1 * 4/2003 Hayes ..... A61G 7/002 5/607
6,578,216 B1 6/2003 Aarestad
6,578,857 B1 * 6/2003 Whiteside ..... B25H 5/00 280/32.5
6,601,251 B2 * 8/2003 Paul ..... A61G 7/012 5/611
6,611,979 B2 9/2003 Welling et al.
6,684,427 B2 2/2004 Allen et al.
6,704,954 B2 3/2004 Metz
6,726,279 B1 * 4/2004 Figel ..... A61G 5/006 297/340
6,760,939 B2 7/2004 Ellis et al.
6,822,571 B2 11/2004 Conway
6,826,793 B2 12/2004 Tekulve
6,868,567 B2 3/2005 Edgerton
6,880,189 B2 4/2005 Welling et al.
D505,365 S 5/2005 Thompson et al.
6,910,236 B2 6/2005 Rene
6,920,656 B2 7/2005 Roussy
6,938,289 B2 9/2005 Morin
6,941,600 B2 9/2005 Freeborn et al.
6,978,500 B2 * 12/2005 Osborne ..... A61G 7/0528 5/600
7,000,272 B2 2/2006 Allen et al.
7,003,828 B2 2/2006 Roussy
7,013,510 B1 3/2006 Johnson
7,017,208 B2 3/2006 Weismiller et al.
7,028,358 B2 4/2006 Liu
7,082,630 B2 8/2006 Castonguay et al.
7,107,637 B2 9/2006 Keuk et al.
7,111,348 B2 9/2006 Ellis et al.
7,134,155 B2 11/2006 Freeborn et al.
7,150,056 B2 12/2006 Lemire
7,165,277 B2 1/2007 Taguchi et al.
7,171,708 B2 2/2007 Osborne et al.
7,185,377 B2 3/2007 Roussy
7,207,622 B2 * 4/2007 Cohan ..... A47C 1/143 297/22
7,210,180 B2 5/2007 Malcolm
7,213,279 B2 5/2007 Weismiller et al.

(56) References Cited

U.S. PATENT DOCUMENTS 7,237,288 B2 7/2007 Lemire et al.
7,260,860 B2 8/2007 Chambers et al.
7,296,312 B2 * 11/2007 Menkedick ..... A61B 5/1115 5/611
7,334,277 B2 2/2008 Johnson
7,353,556 B2 4/2008 Ellis et al.
7,363,663 B2 4/2008 Chambers et al.
7,386,900 B2 6/2008 Lemire
7,398,573 B2 7/2008 Ellis et al.
7,406,729 B2 8/2008 Hornbach et al.
7,406,731 B2 8/2008 Menkedick et al.
7,412,734 B2 8/2008 Stryker et al.
7,412,739 B2 8/2008 Derenne et al.
7,421,748 B1 9/2008 Edgerton
7,441,291 B2 * 10/2008 Hayes ..... A47C 20/08 5/617
7,454,805 B2 11/2008 Osborne et al.
7,461,425 B2 12/2008 Chambers et al.
7,464,425 B2 12/2008 Chambers et al.
7,509,697 B2 3/2009 Dorenbeck
7,520,006 B2 4/2009 Menkedick et al.
7,520,008 B2 4/2009 Wong et al.
7,523,515 B2 4/2009 Allen et al.
7,533,429 B2 5/2009 Menkedick et al.
7,559,102 B1 7/2009 Benzo et al.
7,565,710 B2 7/2009 Chambers et al.
7,610,637 B2 11/2009 Menkedick et al.
7,631,379 B2 12/2009 Lindner
7,637,550 B2 12/2009 Menna
7,653,954 B2 2/2010 Hornbach et al.
7,669,263 B2 3/2010 Menkedick et al.
7,690,059 B2 4/2010 Limire et al.
7,698,765 B2 4/2010 Bobey et al.
7,703,157 B2 4/2010 Dorenbeck
7,730,562 B2 6/2010 Hornbach et al.
7,743,441 B2 6/2010 Poulos et al.
7,757,318 B2 7/2010 Poulos et al.
7,784,125 B2 8/2010 Morin et al.
7,784,128 B2 8/2010 Kramer
7,805,782 B2 10/2010 Hakamiun et al.
7,810,188 B2 10/2010 Barthelt
7,832,039 B2 11/2010 Chambers et al.
7,834,768 B2 11/2010 Dixon et al.
7,845,032 B2 12/2010 Chamber et al.
7,849,538 B1 12/2010 Edgerton
7,913,335 B2 3/2011 Carr
7,913,336 B2 3/2011 Morin et al.
7,926,131 B2 4/2011 Menkedick et al.
7,941,881 B2 5/2011 Hayes et al.
7,986,242 B2 7/2011 Dixon et al.
8,051,513 B2 11/2011 Reed et al.
8,056,163 B2 11/2011 Lemire et al.
8,065,764 B2 11/2011 Kramer
8,069,514 B2 12/2011 Poulos et al.
8,074,309 B2 12/2011 Hutchison et al.
8,104,117 B2 1/2012 Heimbrock et al.
8,104,120 B2 1/2012 Hornbach et al.
8,104,122 B2 1/2012 Richards et al.
8,104,123 B2 1/2012 Paz et al.
8,104,188 B1 1/2012 Aguilar
RE43,155 E 2/2012 Allen et al.
RE43,193 E 2/2012 Osbourne et al.
8,117,696 B2 2/2012 Wernqvist et al.
8,122,546 B2 2/2012 Chambers et al.
8,134,473 B2 3/2012 Roussy
8,151,387 B2 4/2012 Osborne et al.
8,176,584 B2 5/2012 Hornbach et al.
RE43,532 E 7/2012 Menkedick et al.
8,234,729 B2 8/2012 Yvernault et al.
8,256,048 B2 9/2012 Bly et al.
8,256,050 B2 9/2012 Wong et al.
8,258,944 B2 9/2012 Riley et al.
8,266,742 B2 9/2012 Andrienko
8,291,532 B2 10/2012 Hornbach et al.
8,321,976 B1 12/2012 Edgerton
8,341,779 B2 1/2013 Hornbach et al.
8,353,071 B2 1/2013 Turner et al.
8,381,330 B2 2/2013 Roussy et al.
8,393,026 B2 3/2013 Dionne et al.
8,413,274 B2 4/2013 Weismiller et al.
8,418,291 B2 4/2013 Hornbach et al.
8,474,076 B2 7/2013 Hornbach
8,516,634 B2 8/2013 Turner et al.
8,533,877 B2 9/2013 Weiler
8,539,625 B2 9/2013 Poulos et al.
8,601,618 B2 12/2013 Benzo et al.
8,607,384 B2 12/2013 Hornbach
8,621,690 B2 1/2014 Hornbach et al.
8,650,686 B2 2/2014 Biggie et al.
8,984,685 B2 3/2015 Robertson et al.
8,997,588 B2 4/2015 Taylor
9,135,804 B2 9/2015 Hann
9,149,400 B2 10/2015 Serhan
9,167,968 B2 10/2015 Saeed et al.
9,220,651 B2 12/2015 Hyde et al.
9,320,663 B2 4/2016 Poulos et al.
9,381,125 B2 7/2016 Herbst et al.
2002/0029423 A1 3/2002 Ellis et al.
2002/0066142 A1 6/2002 Osborne et al.
2002/0148044 A1 10/2002 Hayes et al.
2002/0178502 A1 * 12/2002 Beasley ..... A61G 7/015 5/618
2003/0019042 A1 1/2003 Ellis et al.
2003/0093862 A1 5/2003 Hanson et al.
2004/0049408 A1 3/2004 Voss et al.
2004/0189475 A1 9/2004 Cooper et al.
2004/0261185 A1 12/2004 Ellis et al.
2005/0125899 A1 6/2005 Hanson et al.
2005/0200181 A1 * 9/2005 Dehli ..... A47C 1/03283 297/344.12
2006/0026767 A1 2/2006 Chambers et al.
2006/0085913 A1 4/2006 Kawakami et al.
2006/0085914 A1 4/2006 Peterson et al.
2006/0117479 A1 6/2006 Kawakami et al.
2006/0225203 A1 10/2006 Hosoya et al.
2007/0011817 A1 1/2007 Ellis et al.
2007/0017032 A1 1/2007 Ellis et al.
2007/0083992 A1 4/2007 Lindner et al.
2007/0089238 A1 4/2007 Kramer et al.
2007/0136949 A1 6/2007 Richards et al.
2007/0174967 A1 * 8/2007 Bourgraf ..... A61G 1/017 5/618
2008/0005847 A1 1/2008 Chambers et al.
2008/0005848 A1 1/2008 Chambers et al.
2008/0010752 A1 1/2008 Chambers et al.
2008/0147442 A1 6/2008 Warner et al.
2008/0246295 A1 * 10/2008 Bejin ..... B60P 1/003 296/61
2009/0070942 A1 3/2009 Chambers et al.
2009/0249552 A1 10/2009 Chambers et al.
2009/0293197 A1 12/2009 Larson et al.
2010/0064441 A1 3/2010 Barthelt
2010/0257672 A1 10/2010 Poulos et al.
2010/0325797 A1 12/2010 Horne
2011/0047709 A1 3/2011 Tarsaud et al.
2011/0087113 A1 4/2011 Mack et al.
2011/0099723 A1 5/2011 Chambers et al.
2011/0232001 A1 9/2011 Poulos et al.
2012/0060291 A1 3/2012 Gamman
2012/0078144 A1 3/2012 Sinykin
2012/0096644 A1 4/2012 Heimbrock
2012/0271654 A1 10/2012 Croghan et al.
2013/0036550 A1 2/2013 Bly et al.
2013/0055502 A1 3/2013 Kay et al.
2013/0085777 A1 4/2013 Scheurich et al.
2013/0102930 A1 4/2013 Connor
2013/0174341 A1 7/2013 Shang
2013/0180051 A1 7/2013 Roussy et al.
2013/0219382 A1 8/2013 Parsons et al.
2013/0219622 A1 8/2013 Hornbach et al.
2013/0227787 A1 9/2013 Herbst et al.
2013/0232690 A1 9/2013 Hornbach et al.
2013/0298331 A1 11/2013 Bossingham et al.
2013/0318720 A1 12/2013 Connell et al.

(56) References Cited

U.S. PATENT DOCUMENTS

| | | | | |
|---|---|---|---|---|
| 2014/0026325 | A1 | 1/2014 | Guthrie | |
| 2014/0033435 | A1 | 2/2014 | Jutras | |
| 2014/0047641 | A1 | 2/2014 | Thodupunuri et al. | |
| 2014/0257057 | A1 | 9/2014 | Reis Cunha et al. | |
| 2014/0265497 | A1 | 9/2014 | Hough et al. | |
| 2014/0265500 | A1* | 9/2014 | Hough | A61G 5/14 297/340 |
| 2014/0304915 | A1 | 10/2014 | Lachenbruch | |
| 2014/0323884 | A1 | 10/2014 | Sullivan et al. | |
| 2014/0345058 | A1 | 11/2014 | Escobedo et al. | |
| 2014/0346756 | A1* | 11/2014 | Laffan | B62B 9/26 280/648 |
| 2015/0128347 | A1 | 5/2015 | Hutchinson et al. | |
| 2015/0137988 | A1 | 5/2015 | Gravenstein et al. | |
| 2015/0164408 | A1 | 6/2015 | Russell et al. | |
| 2015/0164722 | A1* | 6/2015 | Roussy | A61G 7/0507 5/430 |
| 2015/0351981 | A1 | 12/2015 | Sazonov | |
| 2015/0371522 | A1 | 12/2015 | Mravyan et al. | |
| 2016/0089283 | A1 | 3/2016 | DeLuca et al. | |
| 2016/0193095 | A1 | 7/2016 | Roussy et al. | |
| 2016/0364263 | A1 | 12/2016 | Furman et al. | |

FOREIGN PATENT DOCUMENTS

| | | | |
|---|---|---|---|
| CA | 2301609 | A1 | 3/1999 |
| CA | 2393880 | A1 | 1/2004 |
| CA | 2505097 | A1 | 9/2006 |
| CA | 2505101 | A1 | 9/2006 |
| CA | 2565836 | C | 1/2012 |
| CN | 201558246 | | 8/2010 |
| CN | 101856293 | | 10/2010 |
| CN | 202515914 | | 11/2012 |
| CN | 104851250 | | 8/2015 |
| DE | 69808941 | T2 | 2/2003 |
| EP | 0853918 | A2 | 7/1998 |
| EP | 1234565 | A2 | 8/2002 |
| EP | 1234565 | B1 | 8/2002 |
| EP | 1234565 | A3 | 12/2002 |
| EP | 2289477 | B1 | 3/2011 |
| EP | 2698137 | A1 | 2/2014 |
| EP | 2954884 | A1 | 12/2015 |
| EP | 3058923 | A1 | 8/2016 |
| GB | 2160343 | | 12/1985 |
| GB | 2439750 | | 9/2008 |
| JP | 2006330951 | | 12/2006 |
| JP | 2008027030 | | 2/2008 |
| JP | 2013526900 | | 6/2013 |
| JP | 2016028675 | A | 3/2016 |
| KR | 20120072701 | | 7/2012 |
| TW | 201019894 | | 6/2010 |
| WO | 9834577 | | 8/1998 |
| WO | WO9909865 | A1 | 3/1999 |
| WO | WO9941537 | A1 | 8/1999 |
| WO | 0100089 | A1 | 1/2001 |
| WO | 0195848 | A2 | 12/2001 |
| WO | WO2004021952 | A2 | 3/2004 |
| WO | 2013159074 | A2 | 10/2013 |
| WO | WO2013170371 | A1 | 11/2013 |
| WO | WO2014018758 | A1 | 1/2014 |
| WO | 2014172756 | A1 | 10/2014 |
| WO | WO2014201379 | A2 | 12/2014 |
| WO | WO2014201379 | A3 | 12/2014 |
| WO | 2015054423 | A1 | 4/2015 |

* cited by examiner

PATIENT SUPPORT APPARATUS WITH STABILIZATION

CROSS-REFERENCE TO RELATED APPLICATIONS

This application claims priority to U.S. provisional patent application Ser. No. 62/408,120 filed Oct. 14, 2016, by inventors Anish Paul et al. and entitled PATIENT SUPPORT APPARATUS WITH STABILIZATION, the complete disclosure of which is incorporated herein by reference.

BACKGROUND

The present disclosure relates to patient support apparatuses, such as, but not limited to, beds, cots, stretchers, recliners, chairs, operating tables, and the like; and more particularly to one or more stabilization features of the patient support apparatus that help stabilize the patient support apparatus.

Patient support apparatuses often include a backrest that can pivot between an upright position and a fully reclined position. In emergency situations, the backrest of the patient support apparatus is desirably moved to a fully reclined position when the patient's heart has stopped beating, or when the application of cardiopulmonary resuscitation (CPR) is desirable. Some prior art patient support apparatuses, however, are not ideally suited for supporting patients while CPR is applied.

SUMMARY

In its various embodiments, the present disclosure provides a patient support apparatus that includes one or more stabilization features that are selectively deployed in emergency situations where the application of CPR is desirable. In some such embodiments, a backrest support member is provided to provide additional support to the backrest and/or to more rigidly maintain the fixed position of the backrest, thereby increasing the effectiveness of compressions applied to the patient's chest. The backrest support member thereby increases the stability of the patient support apparatus when the backrest is reclined in emergency situations. In some embodiments, the backrest support member includes a strut that is deployed. In other embodiments, the patient support apparatus additionally includes a leg rest support member to provide support to the leg rest. In yet other embodiments, the patient support apparatus includes an expandable base. The patient support apparatus may also include a combination of a backrest support member and an expandable base. These and/or other features are disclosed in the various embodiments discussed herein.

According to one embodiment of the disclosure, a patient support apparatus includes a base, a seat support by the base, a backrest, and a backrest support member. The backrest is pivotable between an upright position and a reclined position. The backrest support member is coupled to the backrest and moves between a stowed position in which the backrest support member does not contact a support and a deployed position in which the backrest support member does contact the support.

According to other aspects, the support is a floor on which the patient support apparatus is positioned. In some embodiments, the backrest support member has a first end pivotably coupled to the backrest and a second end which abuts the floor when the backrest support member is in the deployed position. In other embodiments, the backrest support member moves between the stowed position and the deployed position when an angle of the backrest relative to the floor satisfies a predetermined threshold. In still other embodiments, the seat is adapted to move to a height in which the backrest support member contacts the floor when the backrest support member is deployed.

The patient support apparatus also includes, in some embodiments, a leg rest pivotable between a retracted position and an extended position and a leg rest support member. The leg rest support member moves between a stowed position in which the leg rest support member does not contact the floor and a deployed position in which the leg rest support member contacts the floor. The leg rest support member is adapted to move into the deployed position when the backrest support member moves into the deployed position. In other embodiments, the leg rest and the leg rest support member are adapted to move to the extended and deployed positions, respectively, when the backrest support member moves to the deployed position.

According to other aspects, the backrest support member automatically moves into the deployed position when a CPR control is activated. In such situations, the backrest pivots to the reclined position and the backrest support member moves to the deployed position. In some embodiments, the backrest support member comprises a telescoping member.

According to another embodiment, the patient support apparatus further includes a first actuator for pivoting the backrest, a second actuator for moving the backrest support member, and a control system adapted to coordinate movement of the first and second actuators. The patient support apparatus can further include a user interface having an electrically operated button, wherein selection of the electrically operated button causes the control system to coordinate movement of the first and second actuators to pivot the backrest into a fully reclined position and to deploy the backrest support member.

In still another embodiment, the patient support apparatus further includes one or more manual actuators for moving the backrest and the backrest support member. An electric motor may be added to supplement the manual force when an emergency control (e.g. CPR) is activated. The electric motor is may be placed in a freewheeling state when the emergency control is activated. Activation of the emergency control may also trigger a manual or electric movement of the backrest to the reclined position if the backrest is not already in the reclined position when the emergency control is activated.

In another embodiment, the backrest support member is only manually moveable into the deployed position. In yet another embodiment, a first control moves the backrest to the reclined position with the backrest support member remaining in the stowed position and a second control moves the backrest to the reclined position with the backrest support member moved to the deployed position. The first control is a non-emergency control and the second control is an emergency control.

According to another embodiment, a patient support apparatus includes a base having a first base portion and a second base portion moveable with respect to the first base portion, a seat supported by the base, a backrest pivotable between an upright position and a reclined position, and a control system adapted to move the second base portion between a retracted position and an extended position underneath the backrest.

In some embodiments, the patient support apparatus includes a leg rest pivotable between a retracted position and an extended position and a third base portion moveable with respect to the first base portion. The control system is adapted to move the third base portion between a retracted position and an extended position underneath the leg rest when the leg rest is in its extended position.

In other embodiments, the control system is adapted to move the backrest between the upright position and the reclined position independent of moving the second base portion between the retracted and extended positions. In some embodiments, the control system is adapted to coordinate movement of the backrest between the upright position and the reclined position with movement of the second base portion between the retracted and extended position.

In yet another embodiment, the patient support apparatus further includes a wheel coupled to the first base portion and a brake for the wheel. The control system places the brake in the braked state when the second base portion moves between the retracted and extended positions. In some embodiments, the brake is moveable between a retracted position and a deployed position in which the brake contacts the floor to inhibit movement of the patient support apparatus relative to the floor. The control system in this embodiment is adapted to deploy the brake when the second base portion moves between the retracted and extended positions.

In other embodiments, a backrest support member is adapted to support the backrest on the second base portion. In some aspects, the patient support apparatus further includes a leg rest movable between a retracted position and an extended position, and a third base portion moveable with respect to the first base portion between a retracted position and an extended position. The patient support apparatus also includes a leg rest support member adapted to support the leg rest on the third base portion.

In other aspects, the backrest support member is mounted to the backrest and adapted to move between a stowed position in which the backrest support member does not contact the second base portion and an extended position in which the backrest support member engages the second base portion. In some embodiments, the control system coordinates the movement of the backrest support member and the second base portion. Additionally, or alternatively, the backrest support member is manually moveable into the deployed position.

According to another embodiment, a user interface includes a control that causes the control system to coordinate movement of the backrest into the reclined position and movement of the second base portion into the extended position. In other embodiments, the control system is adapted to move the second base portion between the retracted and extended positions based on an angle of the backrest with respect to a floor.

According to yet another embodiment, a patient support apparatus includes a base having first and second base portions. The first base portion includes a brake system and the second base portion includes a wheel on which the second base portion is moveable across a floor. A seat is supported by the base and a backrest is pivotable between an upright position and a reclined position. The second base portion is moveable with respect to the first base portion between a retracted position and an extended position underneath the backrest. The second base portion remains in the retracted position when the backrest is in the reclined position and a control is not activated and moves to the extended position when the control is activated.

In some embodiments, the control powers a manual actuator, an electrical actuator, or both. In other embodiments, activation of the control places one or more brakes in a braked state.

In still other embodiments, the patient support apparatus also includes a leg rest and a third base portion. The leg rest is pivotable between a retracted position and an extended position, and the third base portion includes a wheel on which the third base portion is moveable across the floor. The third base portion is moveable with respect to the first base portion between a retracted position and an extended position. The third base portion remains in the retracted position when the leg rest is in the extended position and the control is not activated. The third base portion moves to the extended position when the control is activated. In some embodiments, the third base portion is mechanically or electrically linked to the second base portion such that the two extend and retract together. The control is an emergency control, in some embodiments.

According to another embodiment, the patient support apparatus further includes a first actuator for switching the brake system between a braked state and unbraked state, a second actuator for moving the backrest between the upright and reclined positions, and a third actuator for moving the second base portion between the retracted and extended positions. A control system is also included that causes the third actuator to move the second base portion to the extended position and the first actuator to place the brake system in the braked state when the control is activated and the backrest is moved to the reclined position.

In another embodiment, a backrest support member is adapted to support the backrest on the second base portion. In one embodiment, the backrest support member is mounted to the backrest and adapted to move between a stowed position adjacent the backrest and a deployed position in which the backrest support member engages the second base portion. The backrest support member can be adapted to be manually moved into the deployed position. Alternatively, the backrest support member is mounted on the second base portion.

According to another embodiment, a patient support apparatus includes a base, a seat supported by the base, and a backrest pivotable between an upright position and a reclined position. The backrest includes a first end about which the backrest pivots and a second end, opposite the first end. A backrest support member remains in the stowed position when a non-emergency control is activated and moves into the deployed position to support the backrest when an emergency control is activated.

According to one embodiment, the backrest support member has a first end coupled to the backrest and a second end which contacts one of the base or a floor in the deployed position.

In another embodiment, a leg rest is pivotable between a retracted position and an extended position. The leg rest comprises a first end about which the leg rest pivots and a second end, opposite the first end. A leg rest support member is adapted to move between a stowed position and a deployed position in which the leg rest support member supports the leg rest between the first and second ends. The leg rest support member remains in the stowed position and the leg rest cantilevers from the first end when the leg rest is in the retracted position and an emergency control is not activated. The leg rest support member moves into the deployed position to support the leg rest between the first and second ends when the emergency control is activated. In some aspects, the leg rest support member is adapted to move into the deployed position when the backrest support member moves into the deployed position.

Before the various embodiments disclosed herein are explained in detail, it is to be understood that the claims are not to be limited to the details of operation, to the details of construction, or to the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
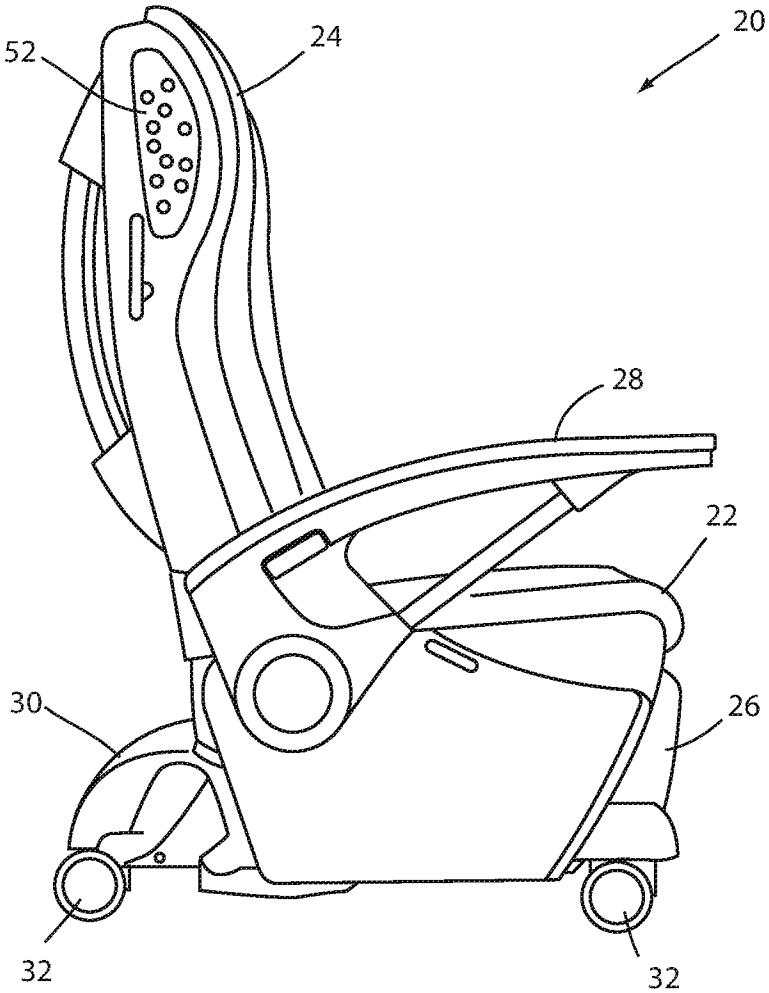
FIG. 1 is a side elevation view of one embodiment of a patient support apparatus according to one aspect of the present disclosure.
Figure 2:
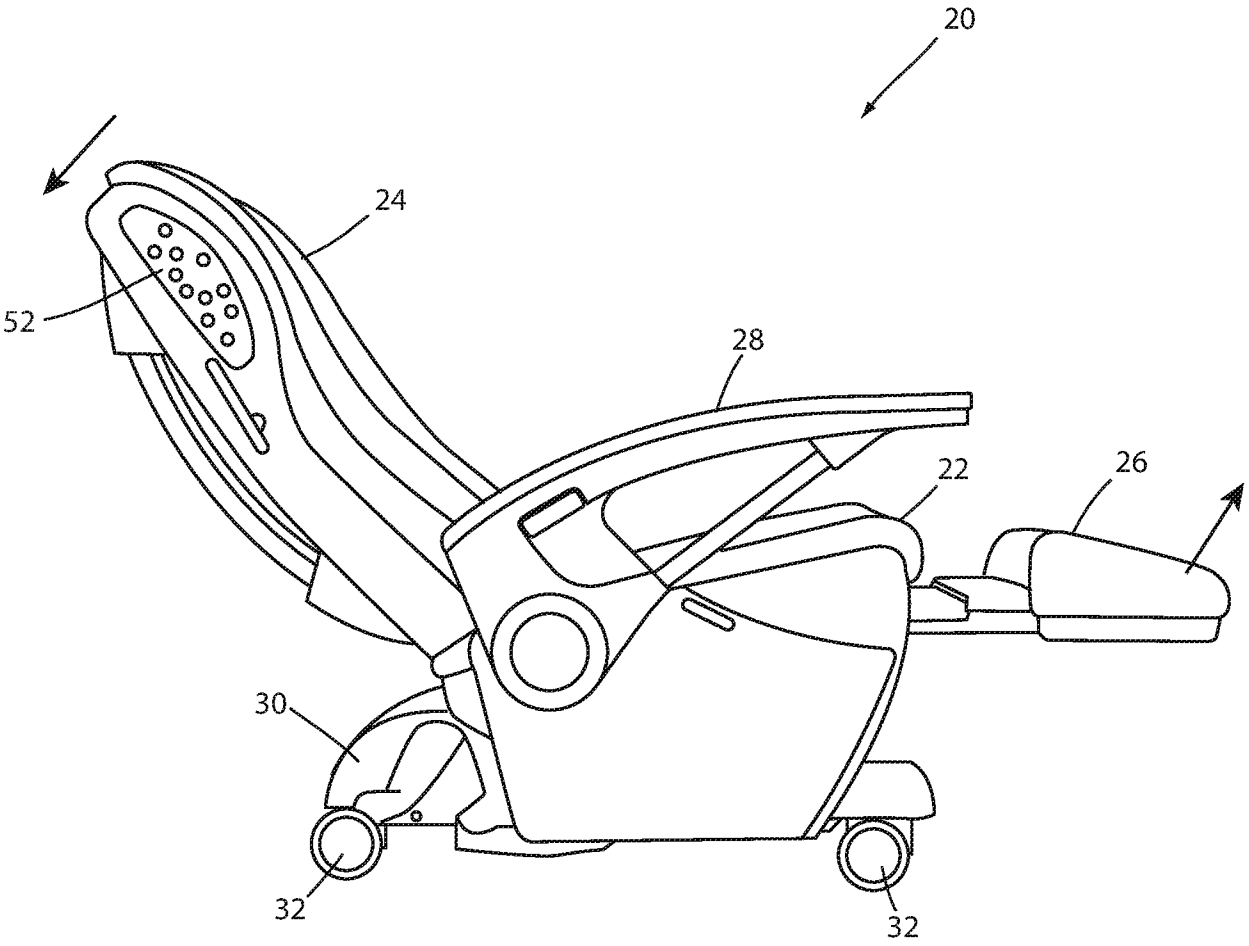
FIG. 2 is a side elevation view of the patient support apparatus of FIG. 1 shown with its backrest pivoted to a reclined position and its leg rest extended.
Figure 4:
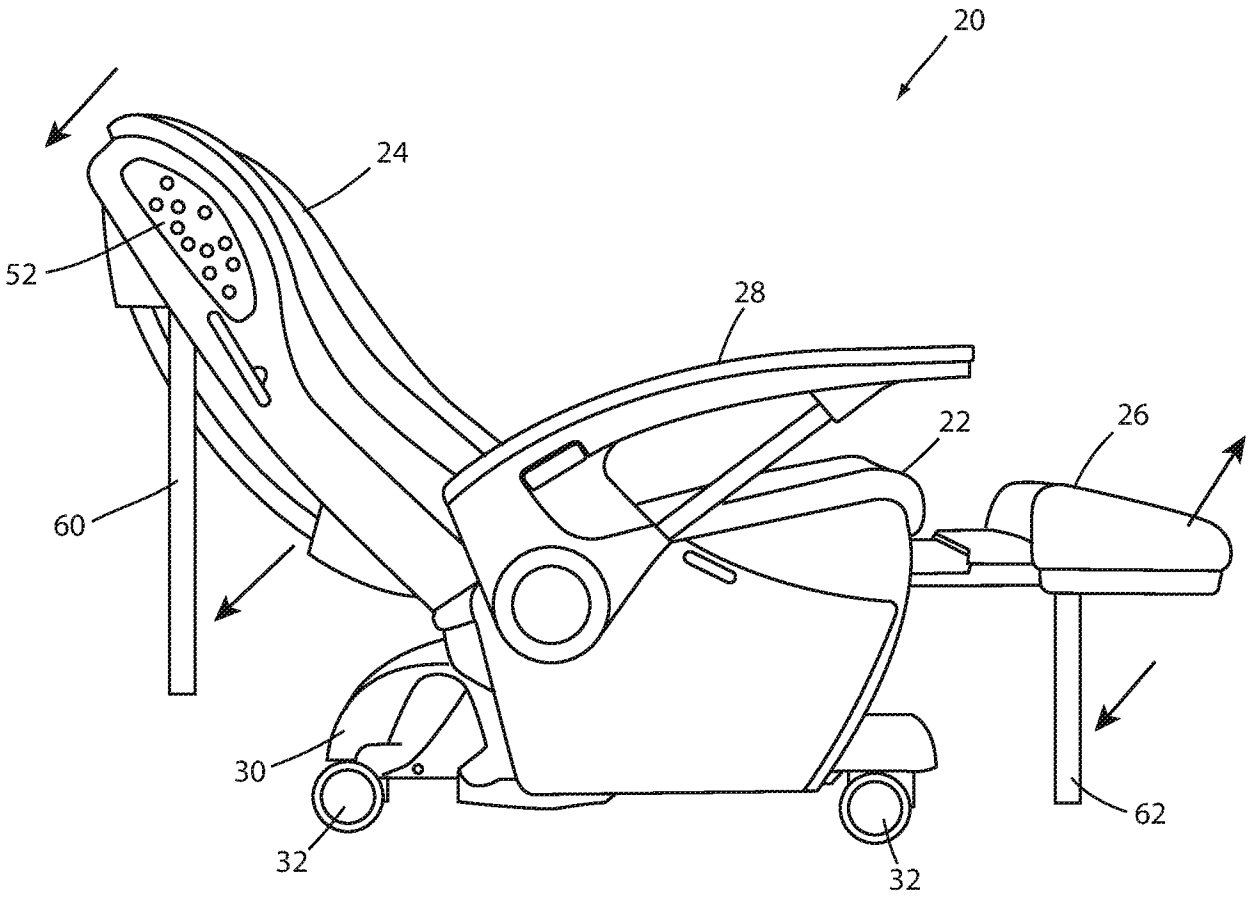
FIG. 4 is a side elevation view of the patient support apparatus of FIG. 1 shown with a backrest support member and leg rest support member moved to their deployed positions.

A patient support apparatus 20 according to one embodiment is shown in FIGS. 1, 2, and 4. Patient support apparatus 20 is shown in these drawings to be a recliner. Although the following written description will be made with respect to a recliner, it will be understood by those skilled in the art that the principles disclosed herein may also be incorporated into other types of patient support apparatuses besides recliners, such as, but not limited to, beds, stretchers, cots, surgical tables, chairs, or the like.

Patient support apparatus 20 includes a seat 22, a backrest 24, a leg rest 26, a pair of armrests 28, a base 30, and a plurality of caster wheels 32 (FIGS. 1 & 2). Patient support apparatus 20 is constructed such that both the height and tilt of seat 22 is adjustable. Further, patient support apparatus 20 is constructed such that backrest 24 is pivotable between a generally upright position, such as shown in FIG. 1, and a virtually infinite number of rearwardly reclined positions, one example of which is illustrated in FIG. 2. Leg rest 26 is constructed such that it is able to be moved between a retracted position, such as shown in FIG. 1, and an extended position in which leg rest 26 is oriented generally horizontally and extends forward from seat 22, such as shown in FIG. 2. Armrests 28 can optionally be constructed such that a user can pivot them between a lowered position and a raised position.

In at least one embodiment, those components of patient support apparatus 20 that are not explicitly described herein are constructed in accordance with any of the embodiments disclosed in commonly assigned, co-pending U.S. patent application Ser. No. 14/212,323 filed Mar. 14, 2014, by inventors Christopher Hough et al. and entitled MEDICAL SUPPORT APPARATUS, the complete disclosure of which is incorporated herein by reference. The non-emergency movement and control of patient support apparatus 20 may also be carried out in accordance with the disclosure of commonly assigned, co-pending U.S. patent application Ser. No. 14/801,167 filed Jul. 16, 2015, by inventors Anish Paul et al. and entitled MEDICAL SUPPORT APPARATUS, the complete disclosure of which is also incorporated herein by reference. Patient support apparatus 20 may also be constructed in other manners besides those described in these two commonly assigned patent applications.

Figure 3:
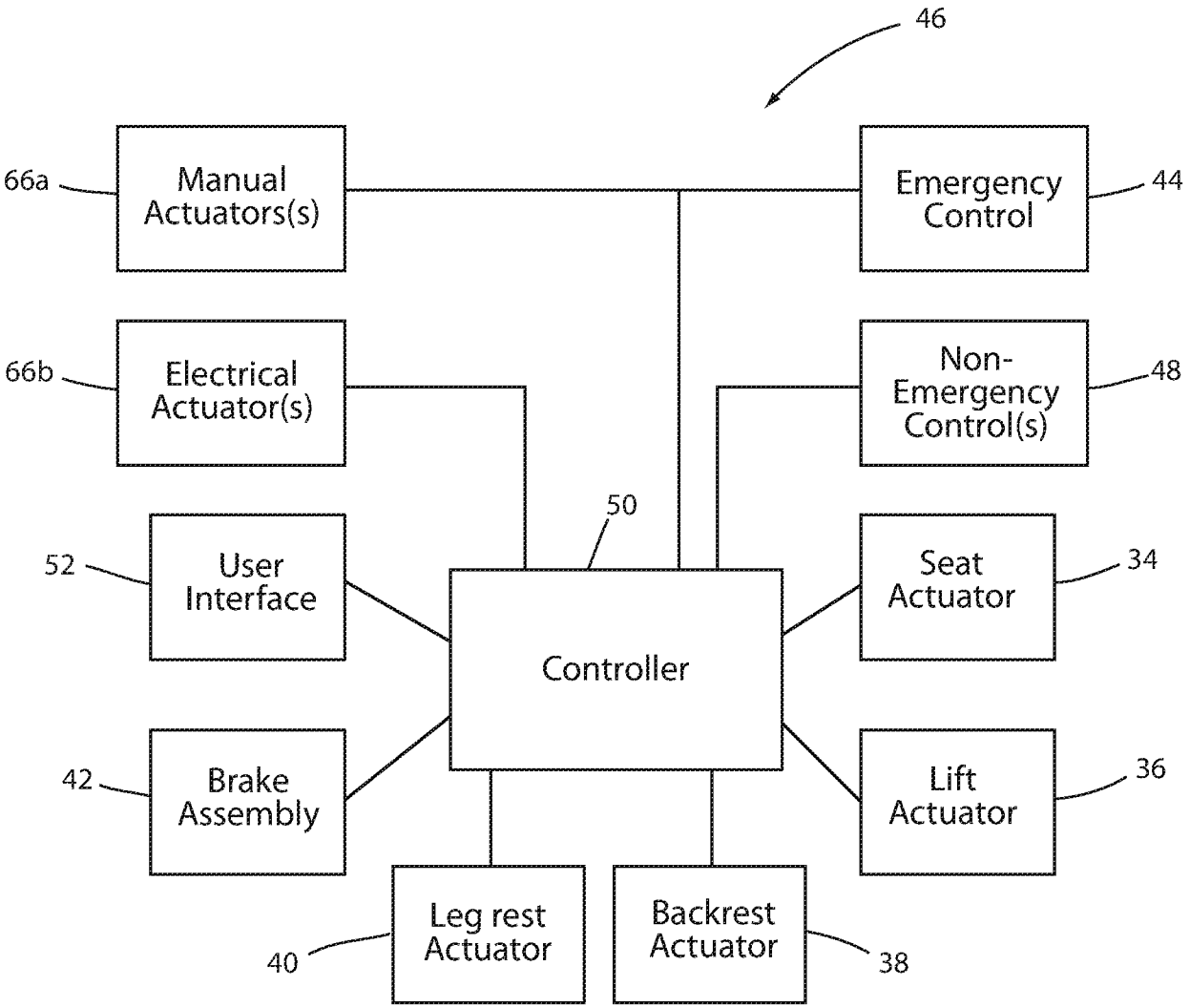
FIG. 3 is a diagram of a control system usable with any of the patient support apparatuses disclosed herein.

FIG. 3 shows one example of a control system 46 that may be incorporated into the patient support apparatus 20 of FIG. 1. Control system 46 includes a seat actuator 34, a lift actuator 36, a backrest actuator 38, a leg rest actuator 40, a brake assembly 42, an emergency control 44, a non-emergency control 48, one or more manual actuators 66*a*, one or more electrical actuators 66*b*, and a controller 50. Each of actuators 34, 36, 38, and 40 are motorized linear actuators that are designed to linearly extend and retract under the control of controller 50. Controller 50 is in communication with one or more user interfaces 52 that may be positioned on each side of backrest 24 (FIGS. 1 and 2). User interface 52 is manipulated by a user in order to control the movement and other functions of patient support apparatus 20.

Controller 50 includes any and all electrical circuitry and components necessary to carry out the functions and algorithms described herein, as would be known to one of ordinary skill in the art. Generally speaking, controller 50 may include one or more microcontrollers, microprocessors, and/or other programmable electronics that are programmed to carry out the functions described herein. It will be understood that controller 50 may also include other electronic components that are programmed to carry out the functions described herein, or that support the microcontrollers, microprocessors, and/or other electronics. The other electronic components include, but are not limited to, one or more field programmable gate arrays, systems on a chip, volatile or nonvolatile memory, discrete circuitry, integrated circuits, application specific integrated circuits (ASICs) and/or other hardware, software, or firmware, as would be known to one of ordinary skill in the art. Such components can be physically configured in any suitable manner, such as by mounting them to one or more circuit boards, or arranging them in other manners, whether combined into a single unit or distributed across multiple units. Such components may be physically distributed in different positions or they may reside in a common location. When physically distributed, the components may communicate using any suitable serial or parallel communication protocol, such as, but not limited to, CAN, LIN, Firewire, I-squared-C, RS-232, RS-485, universal serial bus (USB), etc. One or more of the components may be located on the chair or at a location remote from the chair.

Non-emergency controls 48 are used by the occupant of patient support apparatus 20 (or a caregiver associated therewith) when he or she desires to change the position and/or orientation of any of the seat 22, backrest 24, and/or leg rest 26. These changes are implemented by controller 50 controlling the corresponding seat actuator 34, lift actuator 36, backrest actuator 38, and leg rest actuator 40. Extension and retraction of the seat actuator 34 causes seat 22 to pivot about a seat pivot axis. Extension and retraction of lift actuator 36 causes a frame (not shown) supporting the seat 22 to rise when lift actuator 36 extends and lower when lift actuator 36 retracts, thus raising and lowering the seat 22. In some embodiments, backrest 24 and leg rest 26 are also mounted to the frame such that raising and lowering the frame simultaneously raises and lowers the height of seat 22, backrest 24, and leg rest 26. However, extending and retracting lift actuator 36 does not, by itself, change the angular orientations of any of leg rest 26, backrest 24, and/or seat 22, either with respect to each other or with respect to the floor.

Backrest actuator 38 is mounted to backrest 24 and to the seat frame (not shown). The extension and retraction of backrest actuator 38 therefore causes backrest 24 to pivot with respect to the seat frame. More specifically, when backrest actuator 38 extends, backrest 24 rotates in a counterclockwise direction in FIG. 2. In contrast, when backrest actuator 38 retracts, backrest 24 rotates in a clockwise direction in FIG. 2. In this manner, backrest actuator 38 controls the angle of backrest 24 with respect to the floor (or another fixed reference).

Leg rest actuator 40 is mounted to the seat frame and to leg rest 26. The extension of leg rest actuator 40 therefore pivots leg rest 26 from a retracted position (e.g. FIG. 1) to an extended position in front of seat 22 (FIG. 2). The physical construction of leg rest 26 may take on any of the forms disclosed in the commonly assigned U.S. patent application Ser. No. 14/212,253 mentioned above, whose disclosure is incorporated completely herein by reference. Other physical constructions of leg rest 26 are also possible. The extension and retraction of leg rest actuator 40 changes the orientation of leg rest 26 with respect to the seat frame. The orientation of leg rest 26 with respect to seat frame does not change based on the extension or contraction of any other actuators 34, 36, or 38. The orientation of leg rest 26 with respect to the floor (or some other fixed reference), however, changes when the seat 22 is pivoted by seat actuator 34, or when leg rest actuator 40 pivots leg rest 26.

Each of the actuators 34-40 is powered by a direct current (DC) electrical motor. That is, each of the actuators 34-40 extends or retracts in response to its associated motor being driven in one direction or its opposite direction. The control of each motor is carried out by the controller 50 in communication with the user interface 52. Alternative types of actuators are also contemplated, examples of which include pneumatic actuators, hydraulic actuators, and mechanical actuators. Control system 46 includes one or more emergency controls 44 and non-emergency controls 48 that cause the controller 50 to control the movement of the actuators 34-40 to move the seat 22, the backrest 24, and the leg rest 26, as will be discussed in more detail below. Although FIG. 3 illustrates emergency control 44 and non-emergency control 48 as being separate from user interface 52, it will be understood that in some embodiments, one or both of these controls 44 and 48 are integrated into one or more of the user interfaces 52. In still other embodiments, more than one emergency control 44 and/or non-emergency control 48 are included.

User interface 52 may be constructed in the same manner as, operate in the same manner as, and/or carry out any one or more of the same functions that are carried out using the control panels disclosed in any of the following commonly assigned U.S. patent applications: Ser. No. 14/838,693 filed Aug. 28, 2015 by inventors Daniel Brosnan et al. and entitled PERSON SUPPORT APPARATUS WITH ACTUATOR BRAKE CONTROL; Ser. No. 14/549,006 filed Nov. 20, 2014 by inventors Richard Derenne et al. and entitled PERSON SUPPORT APPARATUSES WITH VIRTUAL CONTROL PANELS; Ser. No. 15/162,653 filed May 24, 2016 by inventors Michael Hayes et al. and entitled USER INTERFACES FOR PATIENT CARE DEVICES; Ser. No. 15/170,979 filed Jun. 2, 2016 by inventors Aaron Furman et al. and entitled PATIENT SUPPORT APPARATUSES WITH DYNAMIC CONTROL PANELS; and Ser. No. 15/185,623 filed Jun. 17, 2016 by inventors Marko Kostic et al. and entitled PERSON SUPPORT APPARATUSES WITH LOAD CELLS, the complete disclosures of all of which are hereby incorporated herein by reference in their entirety.

The non-emergency movement and control of the actuators 34, 36, 38, and/or 40 of patient support apparatus 20 may also be carried out in accordance with the disclosure of commonly assigned, co-pending U.S. patent application Ser. No. 14/984,403 filed Dec. 30, 2015 by inventors Anish Paul et al. and entitled PERSON SUPPORT APPARATUS WITH PIVOTING BACKREST, the complete disclosure of which is also incorporated herein by reference.

Patient support apparatus 20 also includes a brake assembly 42 controlled by controller 50. Brake assembly 42 includes one or more braking mechanisms that are activated and de-activated by controller 50 to place one or more components in a braked or unbraked state. For example, in the illustrated embodiment, brake assembly 42 includes a braking mechanism that is controlled by controller 50 to selectively place one or more of the casters 32 in the braked and unbraked states.

FIG. 4 illustrates patient support apparatus 20 shortly after emergency control 44 has been activated, but prior to patient support apparatus 20 reaching a generally flat orientation conducive for administering CPR to the occupant of patient support apparatus 20. More specifically, FIG. 4 shows patient support apparatus 20 when backrest 24 has been pivoted to the reclined position, leg rest 26 is pivoted to the extended position, a backrest support member 60 is deployed from the backrest 24, and a leg rest support member 62 is deployed from the leg rest 26. Backrest support member 60 is deployed to support backrest 24 and to stabilize patient support apparatus 20. Leg rest support member 62 is deployed to support leg rest 26 and to stabilize patient support apparatus 20.

In a hospital or other type of patient care center, patients who are using patient support apparatus 20 may experience an episode in which cardiopulmonary resuscitation (CPR) is performed on the patient. CPR is recommended to be performed on a patient who is supine on a generally horizontal, rigid surface. In such situations, activation of emergency control 44 automatically configures patient support apparatus 20 to a configuration that is conducive to, and stable enough for, performing CPR. Positioning of backrest 24 into the reclined position in which it is supported on the floor by backrest support member 60 can be referred to as the "CPR configuration", although it will be understood that patient support apparatus 20 can be placed into the CPR configuration at times other than when CPR is being performed. The CPR configuration includes positioning of leg rest 26 into the extended position in which it is supported on the floor by leg rest support 62, although it will be understood that in some embodiments, the CPR configuration does not include positioning of leg rest 26 into the extended position.

In the CPR configuration, backrest 24 is reclined to a generally horizontal or flat orientation conducive for performing CPR on an occupant, although in some embodiments the CPR configuration may correspond to backrest 24 reclined to an angle relative to horizontal. While the embodiments are described in the context of positioning patient support apparatus 20 in a position conducive for performing CPR, it will be understood that other configurations are possible. For example, activation of emergency control 44 may automatically configure patent support apparatus 20 to a Trendelenburg position in which backrest 24 is positioned in a reclined position past horizontal such that an occupant's head is positioned below the occupant's pelvis. In other embodiments, the angle to which backrest 24 is reclined upon activation of emergency control 44 may be adjustable.

Backrest support member 60 can take on a variety of different forms and/or shapes. In the illustrated embodiment, backrest support member 60 is a leg or strut that is pivotably coupled at one end to backrest 24. Backrest support member 60 pivots or otherwise moves between (a) a stowed position in which backrest support member 60 does not provide support to the backrest 24, and (b) a deployed position in which backrest support member 60 contacts the floor, or other rigid structure, and provides stabilizing support to the backrest. In the stowed position, backrest support member 60 is positioned adjacent an exterior, rear surface of backrest 24 or stored within a cavity formed within backrest 24. Alternatively, backrest support member 60 can be in the form of a telescoping leg that is coupled at one end to backrest 24 and extends to support backrest 24 on the floor. Leg rest support member 62 is coupled to leg rest 26 and operates in a manner similar to backrest support member 60 to support leg rest 26 on the floor, or on another rigid structure. Backrest support member 60 and leg rest support member 62 may have a generally circular, rectangular, or other geometric cross-sectional shape. Backrest support member 60 and leg rest support member 62 may be the same or different.

The lengths of backrest support member 60 and leg rest support member 62 are fixed in one embodiment. In such embodiments, the fixed lengths are selected such that the support members 60, 62 contact the floor when backrest 24 and leg rest 26 are in the CPR configuration. Further, the fixed lengths correspond to seat 22 being in a predefined position, such as an unraised position. The predefined height can correspond to a different height in different embodiments. In another example, the length of the backrest and leg rest support members 60, 62 are adjustable such that backrest 24 and foot rest 26 can be supported on the floor at multiple different heights. In such embodiments, the backrest and leg rest support members 60, 62 may be in the form of telescoping legs adapted to lock at one or more predetermined lengths. Alternatively, or additionally, controller 50 can be programmed to control lift actuator 36 to raise or lower seat 22 to a predetermined height when backrest support member 60 is deployed. The predetermined height corresponds to a height at which backrest support member 60 is capable of contacting the floor to support backrest 24.

While only a single backrest support member 60 and leg rest support member 62 are illustrated in the embodiment shown in FIG. 4, it will be understood that patient support apparatus 20 can include more than one backrest support member 60 and/or leg rest support member 62.

Referring again to FIG. 3, control system 46 also includes one or more support member actuators 66*a-b* that are designed to selectively deploy and stow backrest support member 60 and leg rest support member 62. In the illustrated embodiment, control system 46 only deploys backrest support member 60 and leg rest support member 66 in emergency situations in response to activation of emergency control 44. Thus, if a user wishes to change the orientation of patient support apparatus 20 to, for example, the configuration shown in FIG. 2, he or she uses the one or more non-emergency controls 48 to control the various actuators 34, 36, 38, and/or 40 to move the patient support apparatus to this configuration. In so doing, neither backrest support member 60 nor leg rest support member 62 are deployed, even if backrest 24 is moved to the horizontal position and leg rest 26 is moved to the fully extended position.

When a user activates emergency control 44, however, one or more manual actuators 66*a* are activated so as to move back rest support member 60 and leg rest support member 62 to the deployed positions shown in FIG. 4. In some embodiments, one or more electrical actuators 66*b* may also be activated when a user activates emergency control 44. When electrical actuators 66*b* are included, they are designed so as provide powered assistance to the movement of backrest support member 60 and leg rest support member 62 to their deployed positions, but in no way resist the manual movement of these components via manual actuators 66*a* (such as by placing the actuator motors into a freewheeling state). In this manner, if patient support apparatus 20 is not plugged into an electrical outlet, does not have a battery, does have a battery but the battery is drained, or is otherwise not able to provide electrical activation of actuators 66*b*, the deployment of backrest support member 60 and leg rest support member 62 still takes place via manual actuators 66*a*. Electrical actuators 66*b* therefore reduce the manual effort and/or increase the speed at which backrest support member 60 and leg rest support member 62 deploy when electrical power is available and control system 46 is functioning normally, but do not hinder the movement of manual actuators 66*a* if electrical power is not available or there is an electrical problem with one or more components of control system 46.

In some embodiments, a separate manual actuator 66*a* is included for deploying and stowing backrest support member 60 and leg rest support member 62. In other embodiments, a single manual actuator 66*a* is included for deploying and stowing both backrest support member 60 and leg rest support member 62. Similarly, in some embodiments, separate electrical actuators 66*b* are included for deploying and stowing backrest support member 60 and leg rest support member 62, while in still other embodiments, a common electrical actuator 66*b* is used for deploying and stowing both backrest support member 60 and leg rest support member 62. Electrical actuators 66*b* can be motorized linear actuators that are designed to linearly extend and retract under the control of controller 50 in a manner similar to the actuators 34-40 described above. In some embodiments, the electrical actuators 66*b* are motorized rotary actuators.

Emergency control 44, in at least one embodiment, includes a handle or crank that is pulled, pushed, or otherwise physically moved in order to activate manual actuator (s) 66*a* (and in some cases also electrical actuator(s) 66*b*). The motive power for moving backrest support member 60 and leg rest support member 62 comes from, in one embodiment, the motion of the users hand when activating the handle or crank. That is, the handle or crank are mechanically linked to the backrest support member 60 and leg rest support member 62 such that movement of the handle or crank causes deployment of the backrest support member 60 and leg rest support member 62. Additionally, or alternatively, one or more stored physical energy devices (e.g. springs, coils, etc.) may be included that provide the mechanical energy of manual actuators 66*a* for moving backrest support member 60 and leg rest support member 62 to their deployed positions when emergency control 44 is activated.

In addition to activating manual actuator(s) 66*a*, the activation of emergency control 44 also causes an electrical signal to be sent to controller 50. In response to that signal, controller 50 controls electrical actuators 66*b* so as to help facilitate movement of the backrest support member 60 and leg rest support member 60 to their deployed positions. Also in response to that electrical signal, controller 50 determines the current position and orientation of seat 22, backrest 24, and leg rest 26. If backrest 24 is not in its CPR configuration, controller 50 sends a signal to backrest actuator 38 instructing backrest actuator 38 to move backrest 24 to its CPR configuration. Similarly, if seat 22 is not at its desired height (e.g. at its lowest height), controller 50 sends a signal to lift actuator 36 instructing it to move to the desired emergency height. Also, if seat 22 is not oriented at the correct angle for the application of CPR to the occupant of patient support apparatus 20, controller 50 sends a signal to seat actuator 34 instructing it to pivot seat 22 to the proper orientation. Additionally, controller 50 determines if leg rest 26 has been extended or not. If it has not been extended, controller 50 sends a signal to leg rest actuator 40 instructing it to extend leg rest 26 to its CPR configuration.

In some embodiments, control system 46 also includes manual actuators 66*a* for moving not only backrest support member 60 and leg rest support member 62, but also manual actuators 66*a* for moving one or more of seat 22, backrest 24, and leg rest 26. In such embodiments, the additional manual actuators 66*a* move the seat 22, backrest 24, and leg rest 26 to the desired emergency positions and/or orientations such that, in the absence of electrical power (or the presence of an electrical malfunction), patient support apparatus 20 is still able to be moved to an emergency configuration. If electrical power is available, the additional manual actuators 66*a* work harmoniously with the electrical actuators 34, 36, 38, and/or 40 such that seat 22, backrest 24, and leg rest 26 are moved by a combination of manual and electrical forces to their desired emergency positions and/or orientations. In some embodiments, the additional manual actuators 66*a* include a release on one or more of actuators 34, 36, 38, and/or 40 that, when activated, switches the motors of these actuators into a freewheeling mode whereby the spindle of the actuator is able to travel faster than the speed of the motor, thereby allowing manual forces to speed movement of the components (seat 22, backrest 24, and/or leg rest 26) faster than they would otherwise move in response to the motive forces supplied by the actuators' motors.

Controller 50 is programmed to coordinate the movement of backrest actuator 38 such that movement of backrest support member 60 occurs concurrent with the movement of backrest 24. For example, after emergency control 44 is activated, controller 50 controls backrest actuator 38 to move backrest 24 to the horizontal position while manual actuator 66*a* is simultaneously (or sequentially) moving backrest support member 60 to its deployed position. As noted, a separate manual actuator 66*a* may also be present that assists in the movement of backrest 24 to the horizontal position. Simultaneous (or sequential) deployment of leg rest support member 62 by manual actuator 66*a* and extension of leg rest 26 by leg rest actuator 40 (and a manual actuator 66*a*) may also occur.

After the emergency situation is over, controller 50 may control electrical actuator 66*b* to retract backrest support member 60 as backrest 24 is pivoted toward a particular upright position or subsequent to backrest 24 being pivoted into an upright position. Simultaneous (or sequential) retraction of leg rest support member 62 by an electrical actuator 66*b* and retraction of leg rest 26 by leg rest actuator 40 may also occur.

In some embodiments of control system 46, controller 50 does not activate electrical actuators 66*b* except when emergency control 44 is activated. In such embodiments, controller 50 responds to the activation of non-emergency control(s) 48 by activating one or more of actuators 34, 36, 38, and/or 40, but not by actuating any of actuators 66*b*. Thus, for example, if a user wishes to recline backrest 24 to a more horizontal orientation, he or she can manipulate a non-emergency control 48 that causes controller 50 to control backrest actuator 38 such that the backrest pivots to the desired orientation. In carrying out this control, controller 50 does not activate any electrical actuator 66*b* and backrest support member 60 is not deployed, even if backrest 24 moves to the fully horizontal orientation.

In an alternative embodiment, controller 50 is programmed to automatically control the electrical actuator(s) 66*b* even in non-emergency situations. Thus, if backrest 24 is reclined or leg rest 26 is extended, controller 50 also sends instructions to one or more electrical actuators 66*b* to cause backrest support member 60 and leg rest support member 62 to deploy. In still other embodiments, controller 50 may be programmed to deploy backrest support member 60 and/or leg rest support member 62 only in response to one or more predetermined conditions being met. For example, the predetermined condition may include an angle of the backrest 24 relative to the floor satisfying a predetermined threshold. The predetermined threshold can correspond to an angle of backrest 24 when backrest 24 is in the maximum reclined position or some other angle. In this manner, depending on the angle of recline of backrest 24, backrest 24 can be reclined with or without deployment of backrest support member 60. Similarly, leg rest support member 62 may be deployed based on an angle of leg rest 26 relative to the floor satisfying a predetermined threshold. As yet another alternative, leg rest support member 62 may be triggered for deployment when backrest support member 60 is deployed.

In non-emergency situations, when backrest 24 is reclined and backrest support member 60 remains in the stowed condition, backrest 24 cantilevers from the seat frame about the point at which backrest 24 is connected to the seat frame. The cantilevered backrest 24 may not provide sufficient stability and support for performing CPR on a patient in patient support apparatus 20. During CPR, the application of chest compressions to the patient applies a downward force to backrest 24 that could cause the cantilevered backrest 24 to wiggle or patient support apparatus 20 to tip. Any wiggling or other movement of backrest 24 during CPR compressions could decrease the effectiveness of the chest compressions. When emergency control 44 is activated, backrest support member 60 is deployed to support backrest 24 such that backrest 24 is no longer solely supported in a cantilevered manner. Instead, it is supported by backrest support member 60, which provides sufficient support and rigidity to backrest 24 to oppose the CPR forces and to resist tipping of patient support apparatus 20.

As noted, backrest 24 is moved into the CPR configuration at least by way of backrest actuator 38. During an emergency event in which CPR is to be performed, it is often important to begin CPR immediately. The electrical actuator 38 may not move as quickly as desired. In order to expedite this movement, manual force can be applied to move backrest 24 into the CPR configuration. Indeed, the weight of the patient leaning against backrest 24 can speed the movement of backrest 24 to the generally horizontal CPR configuration. The accelerated movement of backrest 24 by way of manual force is accomplished in some embodiments by placing the motor of actuator 38 into a freewheeling state to allow the backrest actuator 38 to be pivoted more quickly in response to manually applied downward forces on backrest 24. In another example, actuation of the emergency control 44 disengages backrest 24 from the electrical motor such that backrest 24 can be manually pushed into the reclined CPR configuration without utilizing the motorized actuator 38. Still further, one or more manual actuators 66*b* may be included that facilitate quick movement of backrest 24 to the reclined CPR configuration after emergency control 44 has been activated.

In some embodiments, backrest support member 60 automatically deploys when backrest 24 is reclined into the generally horizontal orientation of the CPR configuration, regardless of whether or not an emergency situation is present. In such embodiments, backrest support member 60 provides support to backrest 24 any time backrest 24 is pivoted backward. In another embodiment, backrest support member 60 can be adapted to be manually deployed by a user manually pulling backrest support member 60 into the deployed position.

Leg rest 26 and leg rest support member 62 are adapted to move to the extended and deployed positions when emergency control 44 is activated. Leg rest 26 and leg rest support member 62 can move into the CPR configuration in the same manner as described above for backrest 24 and backrest support member 60. In one example, the activation of emergency control 44 activates a manual actuator 66*a* that deploys leg rest support member 62. The activation of emergency control 44 also sends a signal to controller 50 that instructs leg rest actuator 40 to extend leg rest 40. In the absence of electrical power, or an electrical malfunction, emergency control 44 may be tied to a manual actuator 66*a* that releases leg rest actuator 40 such that leg rest 26 retracts to its stowed position under the weight of gravity and/or the patient's legs. Thus, in situations where electrical power is not available or cannot be used to move leg rest 26 to its extended position, control system 46 is designed to cause leg rest 26 to retract to its stowed position. CPR is still able to be performed while leg rest 26 is in its stowed position.

In an alternative embodiment, one or more sources of stored mechanical energy are contained within patient support apparatus 20 and used to move leg rest 26 to its extended position when emergency control 44 is activated and electrical power is not available. As yet another alternative, the weight of the occupant may be used to provide the motive mechanical force for extending leg rest 26 in the absence of electrical power. Still other variations are possible.

Movement of patient support apparatus 20 into the CPR configuration when emergency control 44 is activated may also include moving seat 22 to a predetermined height and controlling brake assembly 42 to place casters 32 in the braked state. The predetermined seat height corresponds to a height at which backrest support member 60 and leg rest support member 62 each contact the floor (after backrest 24 has reclined and leg rest 26 has extended). Seat 22 can be moved into the CPR configuration by the electrical motor of lift actuator 36 and/or through manual force. In one example, the height of seat 22 in the CPR configuration corresponds to the lowest height setting of seat 22. In such embodiments, gravity and/or the occupant's weight may be used to facilitate fast downward movement of the seat to its lowest height. However, other seat heights can be selected for the CPR configuration. Controller 50 is programmed to control brake assembly 42 to place casters 32 in the braked state upon activation of emergency control 44. In another example, brake assembly 42 includes a mechanical brake that is automatically applied to casters 32 when emergency control 44 is activated.

Figure 5:
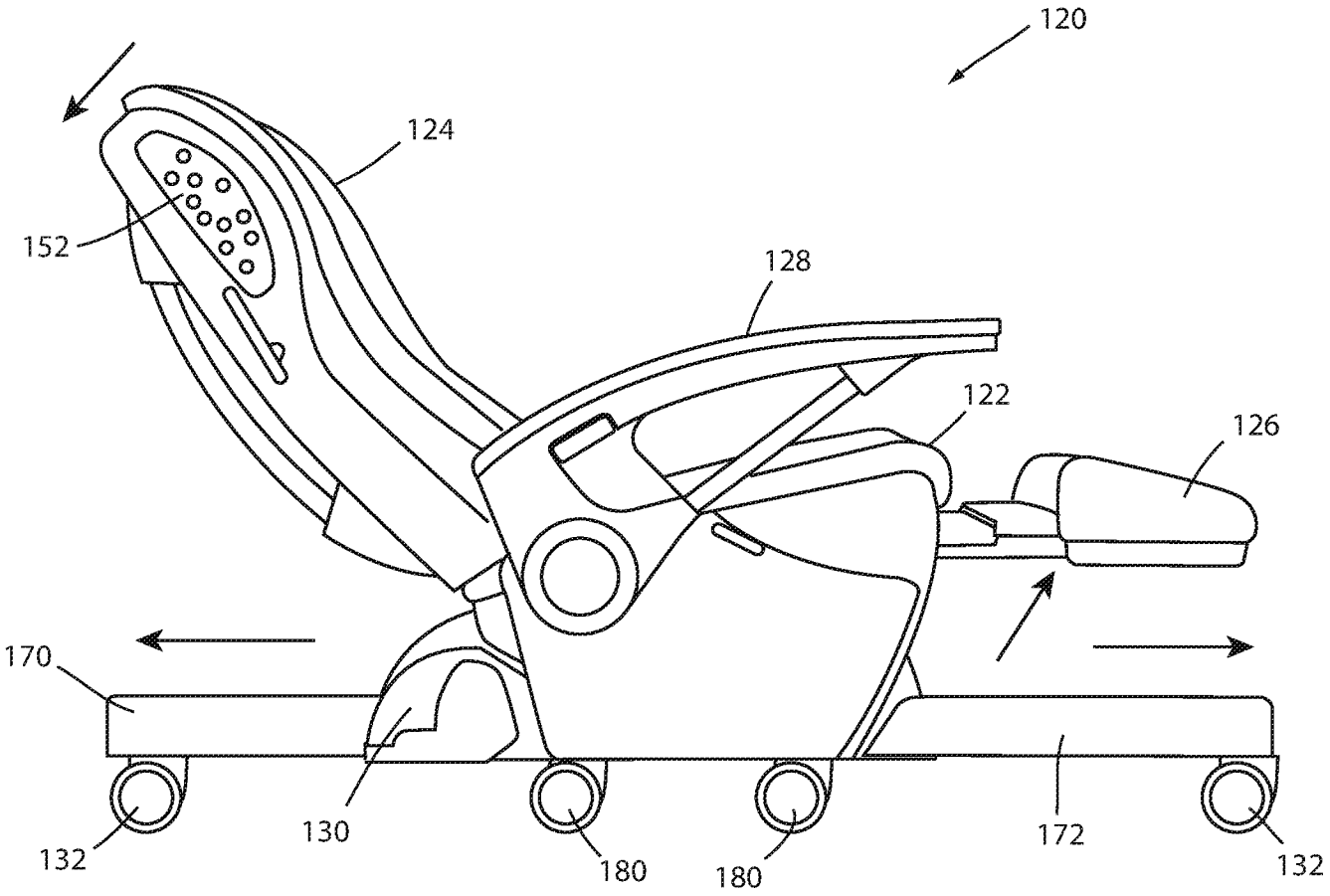
FIG. 5 is a side elevation view of a patient support apparatus according to another embodiment of the present disclosure.

FIG. 5 illustrates a second embodiment of a patient support apparatus 120. Those components of patient support apparatus 120 that are the same as patient support apparatus 20 are identified with the same reference number increased by 100 and, unless otherwise stated, operate in the same manner. Those components that are new to patient support apparatus 120 are provided with a new reference number. Any of the functions and/or components of patient support apparatus 20 that are not present in patient support apparatus 120 can be incorporated into patient support apparatus 120 and vice versa.

Patient support apparatus 120 includes a base 130 having a rear base portion 170 and a front base portion 172 that are moveable with respect to the base 130. The rear and front base portions 170, 172 are moveable with respect to base 130 between extended and retracted positions to provide support and stability to patient support apparatus 120. FIG. 5 illustrates both rear base portion 170 and front base portion 172 in their extended positions. When rear base portion 170 and front base portion 172 are in their retracted position, patient support apparatus 120 may appear the same as how patient support apparatus 20 appears in FIG. 1 or FIG. 2.

Rear base portion 170 and front base portion 172 are controlled by control system 46 in the same manner as control system 46 controls backrest support member 60 and leg rest support member 62 of patient support apparatus 20. That is, rear and front base portions 170, 172 are moveable to the extended positions in response to a user activating emergency control 44. This movement occurs by way of one or more manual actuators 66*a* that extend rear and front base portions 170, 172. In some embodiments, rear and front base portions 170, 172 are connected to separate manual actuators 66*a*, while in other embodiments they are connected to a common manual actuator 66*a*. Further, in response to a user activating emergency control 44, controller 50 receives a signal of this activation and forwards instructions, in at least some embodiments, to one or more electrical actuator (s) 66*b* that extend rear and front base portions 170, 172 to their extended positions. This extension assists, but does not interfere with, the manual movement of rear and front base portions 170 and 172 by the manual actuator(s) 66*a*. The electrical actuators 66*b* may be motorized linear actuators that are designed to linearly extend and retract under the control of the controller 50 in a manner similar to the actuators 34-40 described above. Controller 50 also may also send additional instructions to actuators 34, 36, 38, and/or 40 in order to move patient support apparatus 120 to the CPR configuration, and/or the movement of seat 22, backrest 24, and/or leg rest 26 to the CPR configuration may be carried out by one or more manual actuators 66*a*.

Base 130 includes one or more floor supports 180 for supporting rear and front base portions 170, 172. Floor supports 180 may be casters or another type of support. A brake assembly 142 is controlled by controller 50 to selectively place the casters 132 and 180 in the braked and unbraked states. That is, in response to activation of emergency control 44, controller 50 switches casters 180 to their braked state, thereby resisting movement of patient support apparatus 20 across the floor. Controller 50 switches casters 132 to their unbraked state to allow front and rear base portions 170 and 172 to extend along the floor while being supported by casters 132. In some embodiments, emergency control 44 is also tied to a manual brake activation structure (not shown) that places casters 180 into a braked state. In this manner, the brakes will be activated even in the event of no electrical power, or an electrical malfunction. In one embodiment, base 130 includes a floor brake (not shown) that is stored in an undeployed position. In response to activation of emergency control 44, controller 50 selectively places the floor brake in a deployed position in which the floor brake contacts the floor to resist movement of patient support apparatus 20 across the floor.

In the illustrated embodiment, controller 50 only extends front and rear base portions 170 and 172 in response to activation of emergency control 44. When a user moves backrest 124 to a reclined position and/or extends leg rest 126 to the extended position using non-emergency control(s) 48, front and rear base portions 170 and 172 remain in their retracted positions. In an alternative embodiment, control system 46 may be modified to control rear base portion 170 to automatically extend whenever backrest 124 reclines or to automatically extend when backrest 124 reclines and an additional requirement is satisfied. The additional requirement may comprise backrest 124 reclining to an angle relative to the floor that satisfies a predetermined threshold. In one embodiment, control system 46 may be modified to control front base portion 172 to automatically extend whenever leg rest 126 extends or to automatically extend when leg rest 126 extends and an additional requirement is satisfied. The additional requirement may include rear base portion 170 extending or leg rest 126 extending to an angle relative to the floor that satisfies a predetermined threshold.

As with patient support apparatus 20, control system 46 of patient support apparatus 120 may also control seat actuator 34, lift actuator 36, backrest actuator 38, and leg rest actuator 40 in response to activation of the emergency control 44. Such control is carried out by manual actuation in one embodiment, and by a combination of manual and electrical actuation in another embodiment.

In addition to the control of actuators 34, 36, 38, and 40, control system 46 of patient support apparatus 120 also controls brake assembly 42 such that casters 132 are not braked in an emergency situation. That is, in response to activation of emergency control 44, control system 46 of patient support apparatus 120 releases the brake associated with casters 132 while also activating the brake associated with supports 180. The release of the brake associated with casters 132 allows front and rear base portions 170 and 172 to extend along the floor while being supported by casters 132. The activation of the brake associated with supports 180 ensures that patient support apparatus 120 generally remains stationary during an emergency. In some embodiments, controller 50 is programmed to switch casters 132 to their braked state once front and rear base portions 170 and 172 are in their extended positions.

In an alternative embodiment, controller 50 is programmed to coordinate movement of backrest 124 and rear base portion 170 such that rear base portion 170 extends outwardly as backrest 124 reclines. In one such embodiment, controller 50 is programmed to extend rear base portion 170 to a predetermined position in which a distal end of rear base portion 170 is generally vertically aligned with a distal end of backrest 124. In this manner, rear base portion 170 and backrest 124 have the same "footprint" when viewed from above. Alternatively, rear base portion 170 may be extended to a predetermined position such that the footprint of rear base portion 170 and backrest 124 are not the same. In another example, controller 50 is programmed to extend rear base portion 170 to multiple discrete or infinite positions based on the angle of recline of backrest 124. Controller 50 may also be programmed to extend front base portion 172 whenever leg rest 126 moves to its extended position. In one such embodiment, controller 50 extends front base portion 172 as far as the front edge of leg rest 126 such that front base portion 172 does not give patient support apparatus 120 a larger footprint when viewed from above than it would otherwise have due to the extension of leg rest 126. Alternatively and/or additionally, controller 50 may be programmed to extend front base portion 172 whenever rear base portion 170 moves to its extended position. Such extension may be independent of, or coordinated with, the movement of leg rest 126 to its extended position.

In some embodiments, front base portion 172 and leg rest 126 are mechanically coupled to rear base portion 170 and/or the backrest 124 such that when emergency control 44 is activated, movement of backrest 124 into the reclined position causes extension of front base portion 172 and leg rest 126. In some embodiments, front base portion 172 is adapted to only extend when emergency control 44 is activated and if leg rest 126 is already in the extended position. In such embodiments, if leg rest 126 is not extended, control system 46 may leave both leg rest 126 and front base portion 172 in their retracted positions.

Figure 6:
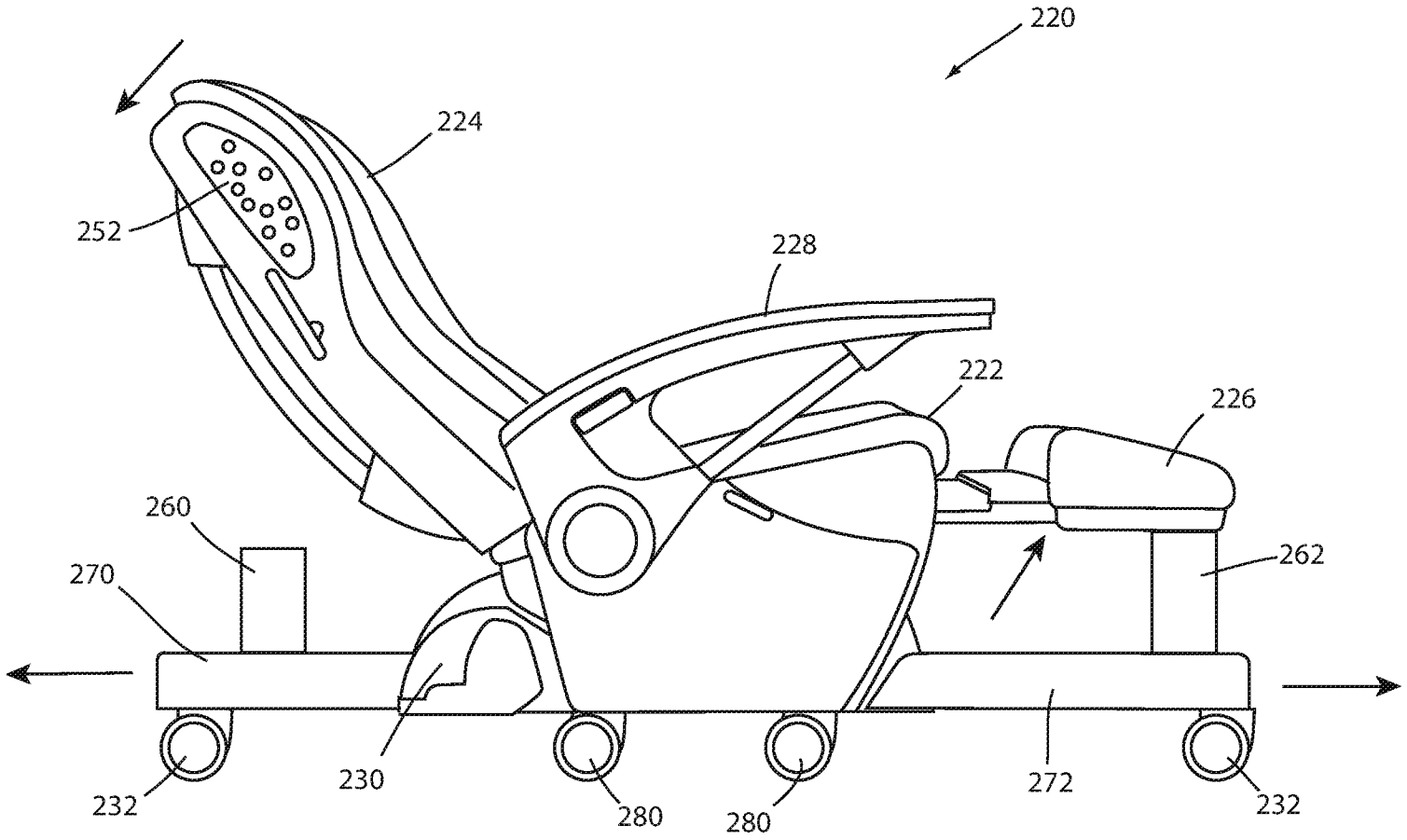
FIG. 6 is a side elevation view of a patient support apparatus according to yet another embodiment of the present disclosure.

FIG. 6 illustrates a third embodiment of a patient support apparatus 220. Those components of patient support apparatus 220 that are the same as patient support apparatus 20 or 120 are identified with the same reference number increased by 200 or 100, respectively, and, unless otherwise stated, operate in the same manner. Those components that are new to patient support apparatus 220 are provided with a new reference number. Any of the functions and/or components of patient support apparatus 20 and/or 120 that are not present in patient support apparatus 220 can be incorporated into patient support apparatus 220 and vice versa.

Patient support apparatus 220 includes control system 46 and operates in any of the same manners described above with respect to patient support apparatus 120. Patient support apparatus 220 includes the same structures as patient support apparatus 120 with the exception of the addition of a backrest support member 260 and a leg rest support member 262. Backrest support member 260 is mounted to a rear base portion 270 and projects upward to support backrest 224 in the reclined position. Leg rest support member 262 is mounted to a front base portion 272 and extends upward to support leg rest 226 when leg rest 226 is extended. In this manner, backrest support member 260 provides support and stability to backrest 224 when backrest 224 is in the reclined position, and leg rest support member 262 provides support and stability to leg rest 226 when leg rest 226 is extended. This support and stability is in addition to the stability provided by the extended rear base portion 270 and extended front base portion. The additional support and stability can be particularly beneficial when the patient support apparatus 220 is in the CPR configuration and chest compressions are being applied to the occupant of patient support apparatus 220. As with the other patient support apparatuses described herein, the extension of rear and front base portions 270 and 272 may only occur in response to the activation of emergency control 44. In such embodiments, the use of non-emergency controls 48 to pivot backrest 224 to its reclined position and/or extend leg rest 226 to its extended position does not cause control system 46 to extend rear and front base portions 270 and 272.

Backrest support member 260, as with backrest support member 60 of patient support apparatus 20, can have fixed or adjustable heights selected to engage a rear face of the backrest 224 when backrest 224 is reclined. Similarly, leg rest support member 262, as well as leg rest support member 62 of patient support apparatus 20, can have a fixed or adjustable height selected to engage a rear face of leg rest 226 when leg rest 226 is extended.

Figure 7:
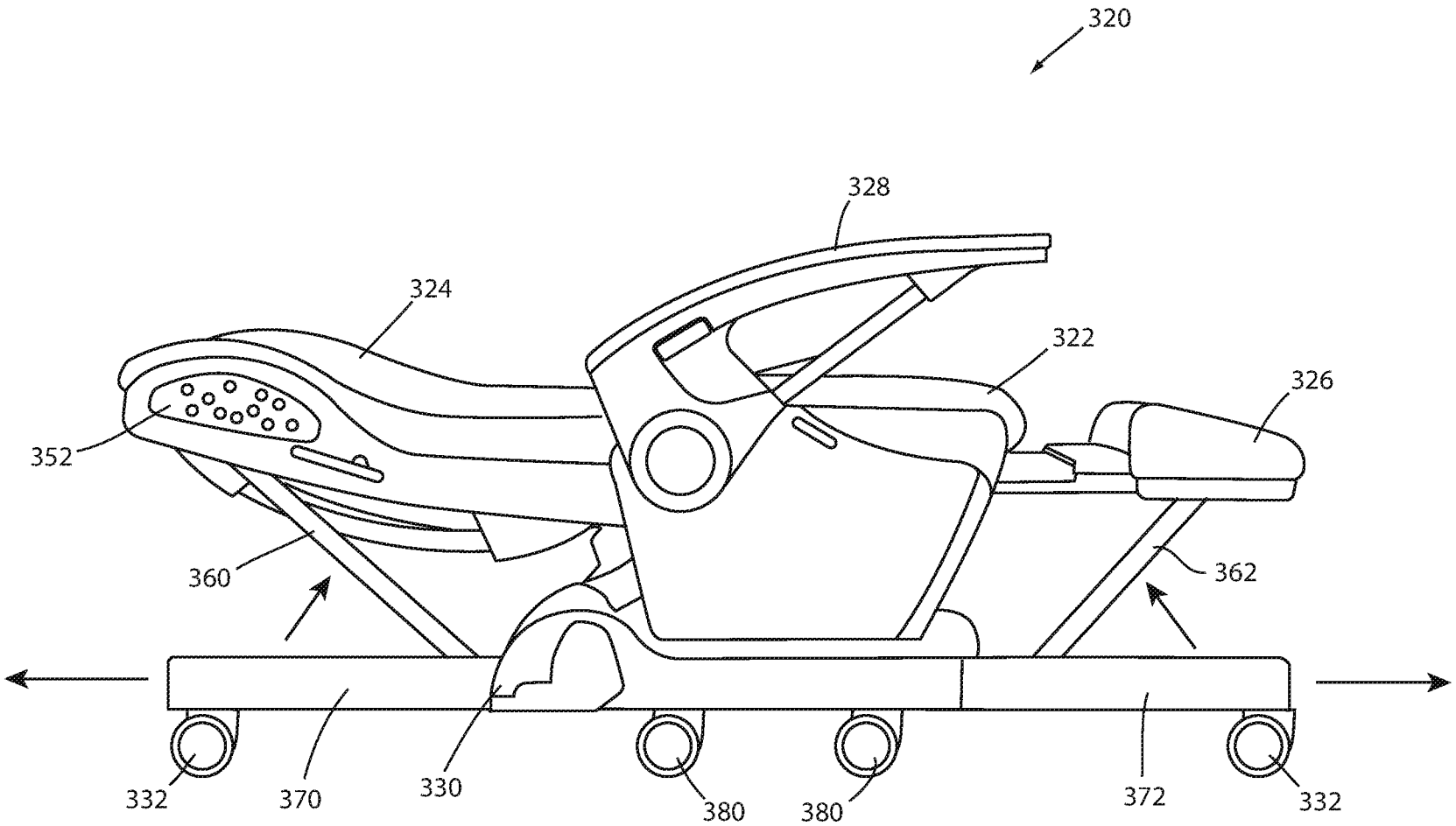
FIG. 7 is a side elevation view of a patient support apparatus according to still another embodiment of the present disclosure.

FIG. 7 illustrates another embodiment of a patient support apparatus 320. Those components of patient support apparatus 320 that are the same as patient support apparatus 20, 120, or 220 are identified with the same reference number increased by 300, 200 or 100, respectively, and, unless otherwise stated, operate in the same manner. Those components that are new to patient support apparatus 320 are provided with a new reference number. Any of the functions and/or components of patient support apparatus 20, 120, and/or 220 that are not present in patient support apparatus 320 can be incorporated into patient support apparatus 320 and vice versa.

Patient support apparatus 320 includes control system 46 and operates in any of the same manners described above with respect to patient support apparatus 120 and 220. Patient support apparatus 320 includes the same structures as patient support apparatus 220 with the exception that supports 260 and 262 have been replaced by supports 360 and 362. Supports 360 and 362 are adapted to pivot between a stowed positioned in which they do not provide support to backrest 324 and leg rest 326, respectively, and a deployed position in which they do provide support to backrest 324 and leg rest 326, respectively. In one embodiment, when supports 360 and 362 are in their stowed positioned, they are oriented generally horizontally and contained within a recess of rear base portion 370 and front base portion 372, respectively. This recess provides sufficient space to house supports 360 and 362 while rear and front base portions 370 and 372 are retracted to their stowed positions.

Control system 46 of patient support apparatus 320 uses one or more manual actuators 66*a* to pivot supports 360 and 362 to their deployed positions in response to activation of emergency control 44. In addition to utilizing manual actuator(s) 66*a*, control system 46 may also be configured to activate one or more electrical actuators 66*b* to help assist in the movement of supports 360 and/or 362, as well as rear and front base portions 370 and 372.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A patient support apparatus comprising:

a base;

a seat supported by the base;

a backrest pivotable between an upright position and a reclined position;

a backrest support member coupled to the backrest and adapted to move between a stowed position in which the backrest support member does not contact a support and a deployed position in which the backrest support member does contact the support;

a first actuator adapted to cause, when activated, the backrest to pivot toward a fully reclined position in which the backrest is supported by the seat in a cantilevered manner, the first actuator adapted to pivot the backrest toward the fully reclined position without causing the backrest support member to move between the stowed and deployed positions;

a second actuator adapted to cause, when activated, the backrest support member to move from the stowed position to the deployed position such that the backrest is supported both by the seat and by the backrest support member, the backrest support member adding additional stability to the backrest;

a first control adapted to activate the first actuator but not the second actuator; and a second control adapted to activate both the first actuator and the second actuator.

2. The patient support apparatus of claim 1 wherein the support is a floor on which the patient support apparatus is positioned.

3. The patient support apparatus of claim 2 further comprising:

a leg rest pivotable between a retracted position and an extended position; and a leg rest support member coupled to the leg rest and adapted to move between a stowed position in which the leg rest support member does not contact the floor and a deployed position in which the leg rest support member contacts the floor;

wherein the leg rest support member is adapted to move to the deployed position when the second control is activated.

4. The patient support apparatus of claim 2 wherein the backrest support member has a first end pivotably coupled to the backrest and a second end which abuts the floor when the backrest support member is in the deployed position.

5. The patient support apparatus of claim 2 further including a seat actuator adapted to move the seat to a specific height when the second control is activated, the specific height defined by the backrest support member contacting the floor.

6. The patient support apparatus of claim 1 wherein the backrest support member comprises a telescoping member.

7. The patient support apparatus of claim 1 further comprising a user interface electrically coupled to the first and second actuators, the user interface including both the first control and the second control.

8. The patient support apparatus of claim 1 wherein the second control includes one of a handle or crank.

9. A patient support apparatus comprising:

a base comprising a first base portion and a second base portion moveable with respect to the first base portion, the second base portion movable between a retracted position and an extended position;

a seat supported by the base;

a backrest pivotable between an upright position and a reclined position;

a first actuator adapted to cause, when activated, the backrest to pivot toward a fully reclined position in which the backrest is supported by the seat in a cantilevered manner without moving the second base portion to the extended position;

a second actuator adapted to cause, when activated, the backrest to pivot toward the fully reclined position and the second base portion to move to the extended position, the extended position of the second base portion providing additional stability to the backrest;

a first control adapted to activate the first actuator but not the second actuator; and a second control adapted to activate both the first actuator and the second actuator.

10. The patient support apparatus of claim 9 further comprising:

a leg rest pivotable between a retracted position and an extended position;

a third base portion moveable with respect to the first base portion, the third base portion movable between a retracted position underneath the seat and a deployed position underneath the leg rest when the leg rest is in the extended position; and a third actuator adapted to cause, when activated, the leg rest to move to the extended position without causing the third base portion to move to the deployed position;

wherein the second actuator is further adapted to respond to activation of the second control by moving the third base portion to the deployed position.

11. The patient support apparatus of claim 10 further comprising:

a backrest support member adapted to support the backrest on the second base portion; and a leg rest support member adapted to support the leg rest on the third base portion;

wherein at least one of the backrest support member and leg rest support member is mounted on the second base portion and third base portion, respectively.

12. The patient support apparatus of claim 9 further comprising:

a wheel coupled with the first base portion;

a brake for the wheel coupled with the first base portion, the brake having a braked state and an unbraked state; and a controller adapted to place the brake in the braked state when the second base portion moves between the retracted and extended positions.

13. The patient support apparatus of claim 9 further comprising a backrest support member adapted to support the backrest on the second base portion.

14. The patient support apparatus of claim 13 further comprising:

a leg rest pivotable between a retracted position and an extended position;

a third base portion moveable with respect to the first base portion between a retracted position and an extended position underneath the leg rest in the extended position; and a leg rest support member adapted to support the leg rest on the third base portion.

15. The patient support apparatus of claim 13 wherein the backrest support member is mounted to the backrest and adapted to move between a stowed position in which the backrest support member does not contact the second base portion and a deployed position in which the backrest support member engages the second base portion.

16. The patient support apparatus of claim 9 wherein the second control includes one of a handle or crank.

17. A patient support apparatus comprising:

a base;

a seat supported by the base;

a backrest pivotable between an upright position and a reclined position;

a backrest support member adapted to move between a stowed position and a deployed position, the backrest support member providing support to the backrest against downward forces when in the deployed position and the backrest support member not providing support to the backrest against downward forces when in the stowed position;

a first actuator adapted to drive the backrest toward a fully reclined position in which the backrest is adapted to support a back of a patient positioned on the patient support apparatus;

a first control adapted to, when activated, drive the first actuator such that the backrest pivots toward the fully reclined position while the backrest support member remains in the stowed position; and a second control adapted to, when activated, cause the backrest support member to move from the stowed position to the deployed position and to cause the backrest to pivot toward the fully reclined position if the backrest is not in the fully reclined position when the second control is activated.

18. The patient support apparatus of claim 17 wherein the backrest support member has a first end coupled to the backrest and a second end which contacts one of the base or a floor in the deployed position.

19. The patient support apparatus of claim 17 further comprising:

a leg rest pivotable between a retracted position and an extended position; and a leg rest support member adapted to move between a stowed position and a deployed position, the leg rest support member providing support to the leg rest against downward forces when in the deployed position and the leg rest support member not providing support to the leg rest against downward forces when in the stowed position;

wherein the leg rest support member remains in the stowed position when the second control is not activated regardless of the position of the leg rest, and the leg rest support member moves to the deployed position when the second control is activated.

20. The patient support apparatus of claim 17 wherein the second control includes one of a handle or crank, and wherein the first actuator is an electrical actuator.

* * * * *